US009468791B2

(12) United States Patent
Lojek

(10) Patent No.: US 9,468,791 B2
(45) Date of Patent: Oct. 18, 2016

(54) SELECTORIZED WEIGHT STACK EJECTING PIN

(71) Applicant: Steven Lojek, Flemington, NJ (US)

(72) Inventor: Steven Lojek, Flemington, NJ (US)

( * ) Notice: Subject to any disclaimer, the term of this patent is extended or adjusted under 35 U.S.C. 154(b) by 0 days.

(21) Appl. No.: 13/999,351

(22) Filed: Feb. 12, 2014

(65) Prior Publication Data

US 2015/0224357 A1 Aug. 13, 2015

Related U.S. Application Data

(60) Provisional application No. 61/850,332, filed on Feb. 14, 2013.

(51) Int. Cl.
*A63B 21/062* (2006.01)

(52) U.S. Cl.
CPC ..... *A63B 21/0628* (2015.10)

(58) Field of Classification Search
CPC ..... A63B 2021/0623; A63B 21/063; A63B 21/0628
See application file for complete search history.

(56) References Cited

U.S. PATENT DOCUMENTS

| | | | | |
|---|---|---|---|---|
| 4,610,449 | A * | 9/1986 | Diercks, Jr. | A63B 21/0628 482/98 |
| 5,556,362 | A * | 9/1996 | Whipps | A63B 21/0628 482/97 |
| 7,766,800 | B1 * | 8/2010 | Krull | 482/93 |
| 8,454,260 | B2 * | 6/2013 | Wilcoxson | 403/315 |
| 8,986,166 | B2 * | 3/2015 | Nishimura | 482/5 |
| 2008/0182731 | A1 * | 7/2008 | Vittone et al. | 482/98 |

* cited by examiner

*Primary Examiner* — Loan H Thanh
*Assistant Examiner* — Rae Fischer
(74) *Attorney, Agent, or Firm* — David R. Conklin; Kirton McConkie

(57) ABSTRACT

A compact, portable weight stack selector pin for use with exercise equipment commonly known as selectorized weight equipment. This invention will allow the user to pre-select multiple resistances to be used in a controlled descending resistance sequence without the need for the trainee to dismount said equipment to reposition the selector pin or pins during the exercise.

13 Claims, 5 Drawing Sheets

11
12
14
15
13
1
2
5
3
4
13
13

Fig 3
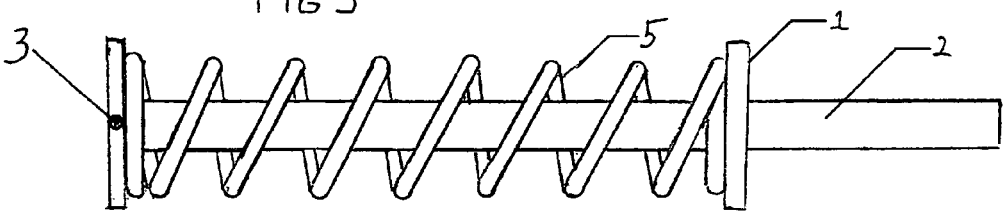
Fig 4
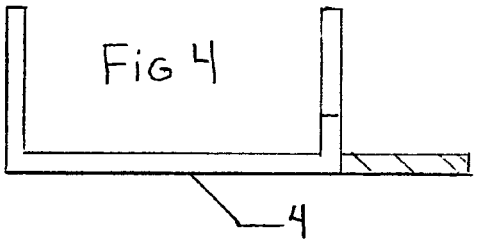
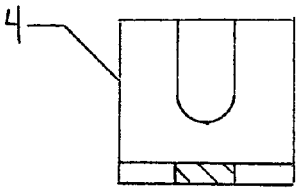
Fig 5
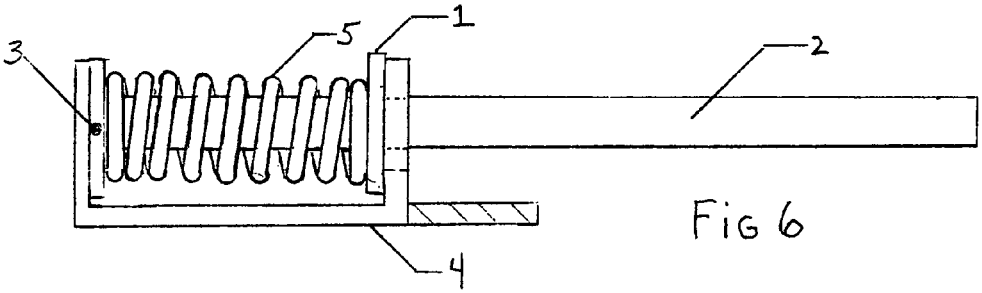
Fig 6
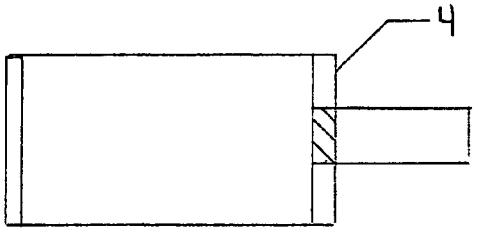
Fig 7

SELECTORIZED WEIGHT STACK EJECTING PIN

RELATED APPLICATION

This U.S. non-provisional utility patent application claims the benefit of U.S. provisional patent Application No. 61/850,332 entitled SELECTORIZED WEIGHT STACK EJECTING PIN filed Feb. 14, 2013, which is incorporated herein by reference in its entirety.

BACKGROUND OF THE INVENTION

This invention is in the technical field of exercise equipment; more particularly the exercise equipment known as selectorized equipment. The present invention relates to resistance training of skeletal muscles utilizing resistance training equipment consisting of a plurality of equal thickness weights plates arranged vertically using guides and a selector shaft with openings or slots corresponding to weight plate slots able to accept an intersecting pin shaft to secure a selection, commonly known in the fitness industry as "selectorized" equipment.

As skeletal muscles are introduced to greater external loads, such as resistance training, they initially are capable of providing the necessary force but only for a few cycles of motion relative to the load applied until the point of momentary muscle failure. At this point the load is too great for the available muscle fibers to concentrically contract but if the load could be quickly reduced, the same movement could be continued immediately, virtually seamlessly with the same perceived effort to the trainee resulting in more complete muscle fiber stimulation and ultimately greater results.

The equipment known as selectorized equipment introduced decades ago and continuously refined was a great improvement over the barbell in terms of safety, user friendliness and acceptance especially among persons intimidated by free weight usage. For all the advantages and refinement selectorized equipment has over it's free weight counterpart one obvious similarity is: the initial resistance chosen by the trainee will remain static from the beginning of the movement to the point of momentary muscular failure. I.E. One hundred pounds of resistance selected before the commencement of the movement remains one hundred pounds during and at the termination of the movement, unless acted upon by external forces. Momentary muscular failure is the absolute termination point of any resistance exercise if not acted upon by external forces. An assistant could provide assistance with additional movement effectively reducing the load experienced by the trainee or the trainee could cease the movement, adjust the selection of resistance then continue. Both scenarios will further enable the trainee to progress but are not ideal as the former requires additional personnel and a rest period, the later requires the trainee to stop, dismount, adjust the selection, remount then continue the movement resulting in a greater rest period, which is counterproductive but the only options available up to this point by the fitness industry.

Other types of resistance equipment not known to the industry as selectorized equipment may provide the benefits of variable, descending resistance during the movement but consist of equipment outside the manufacture and construction of selectorized resistance equipment. These may be pneumatic, hydraulic, and electronic or any combination of but relies on substantially dissimilar technology to apply and vary resistance and are incompatible with claims made in this specification.

The common method of ejecting a pin from a selection slot is a coiled biasing means, a spring, of sufficient power able to eject the shaft from the selection. An assistant can place a suitably sized coiled spring over a standard selector pin shaft, insert into desired selection of a selectorized weight stack, compress the spring by inserting the shaft fully into the selection and hold it stationary until the trainee commences the movement at which point the assistant can be relieved of this duty. Once the weight stack is returned to the resting position, the pin shaft will eject. The existing problem remains the release methods claimed.

U.S. Pat. No. 4,610,449 describe an automatic weight stack selector for exercise equipment employing a timer, and assorted equipment to change weight after a predetermined amount of time. The apparatus described is not portable to a trainee and relies on a timer mechanism with a pre-set time frame to actuate without regard to the trainee's load requirement at any given instant of an exercise.

U.S. Pat. No. 5,556,362 describes a weight stack pin biased by a spring of various material and construction that relies on a specific weight stack construction method and material used in manufacture to achieve the desired function of retaining and or release upon command of the trainee. In drawings and descriptions it describes and shows the units consecutively arranged in selectorized weight stacks without the need to skip a selection to allow any portion of a trigger mechanism to enter any unoccupied selection slots. It describes various methods in the attempt of reliable function of the unit but in practice of construction of the described claims it became apparent of the dissimilarity of the claims to the present invention claim.

Patent Application Publication 2011/0091272A1 describes weight stack pin biased by a spring with a trigger catch. Further description of claimed function describes the engagement and release of unit from a weight stack. "Lifting of the stack plates so as to engage the pop-pin against the stack of weight plates and shock the spring from the unstable equilibrium point to set the loaded spring against the weight stack" This description of claimed function of release by shock is arbitrary and as such would not allow reliable, repeatable function or multiple units to be used during a single exercise.

None of the above references claim, either separately or combined the operation of the following claim of operation of the invention.

SUMMARY OF THE INVENTION

The present invention described as a Selectorized Weight Stack Ejecting Pin can be used with selectorized resistance equipment, of any manufacture or material, which would normally require a trainee to manually insert a selector pin(s) to secure the desired resistance. The present invention, when used in addition to resistance training equipment known as selectorized equipment, once activated will secure the desired selection of resistance when the pin shaft of invention is manually inserted into the desired selection slot of the weight plate and a portion of the trigger latch is able to be inserted into any unoccupied slot of a separate weight plate below the selection. Vertical movement of the weight stack will immediately impose a friction load on the pin shaft and release the trigger latch previously occupying the slot below the shaft. Once selectorized weight stack is returned to the resting position, the mechanical friction imposed on the pin shaft by the selectorized weight stack plates is relieved, allowing the invention to rapidly remove itself from the previously occupied selection as a direct effect of the release of stored energy of the biasing means. This function can be repeated by the trainee in a controlled sequentially descending resistance order by using additional units during the same exercise. The claims of the present invention in construction and use are not dependent on specific materials of manufacture, design of the selectorized weight stack or specialized techniques to be followed by the trainee. It is the intention to create a portable, dependable device that will allow rapid, descending weight change without modification to equipment or additional manual manipulation of equipment once exercise has commenced thus allowing greater variances in resistances used in training sessions than without use of this invention.

BRIEF DESCRIPTION OF DRAWINGS

FIG. 3 illustrates a side view embodiment of a Selectorized Weight Stack Ejecting Pin in its inactive position.

FIG. 4 illustrates a side view embodiment of a detached trigger latch member.

FIG. 5 illustrates a front view of a detached trigger latch member of FIG. 4.

FIG. 6 illustrate the side view embodiment of FIG. 3 in the active position with trigger latch member illustrated in FIG. 4 engaged.

FIG. 7 illustrates a top view embodiment of a detached trigger latch member of FIG. 4.

DETAILED DESCRIPTION OF THE INVENTION

Figure 1:
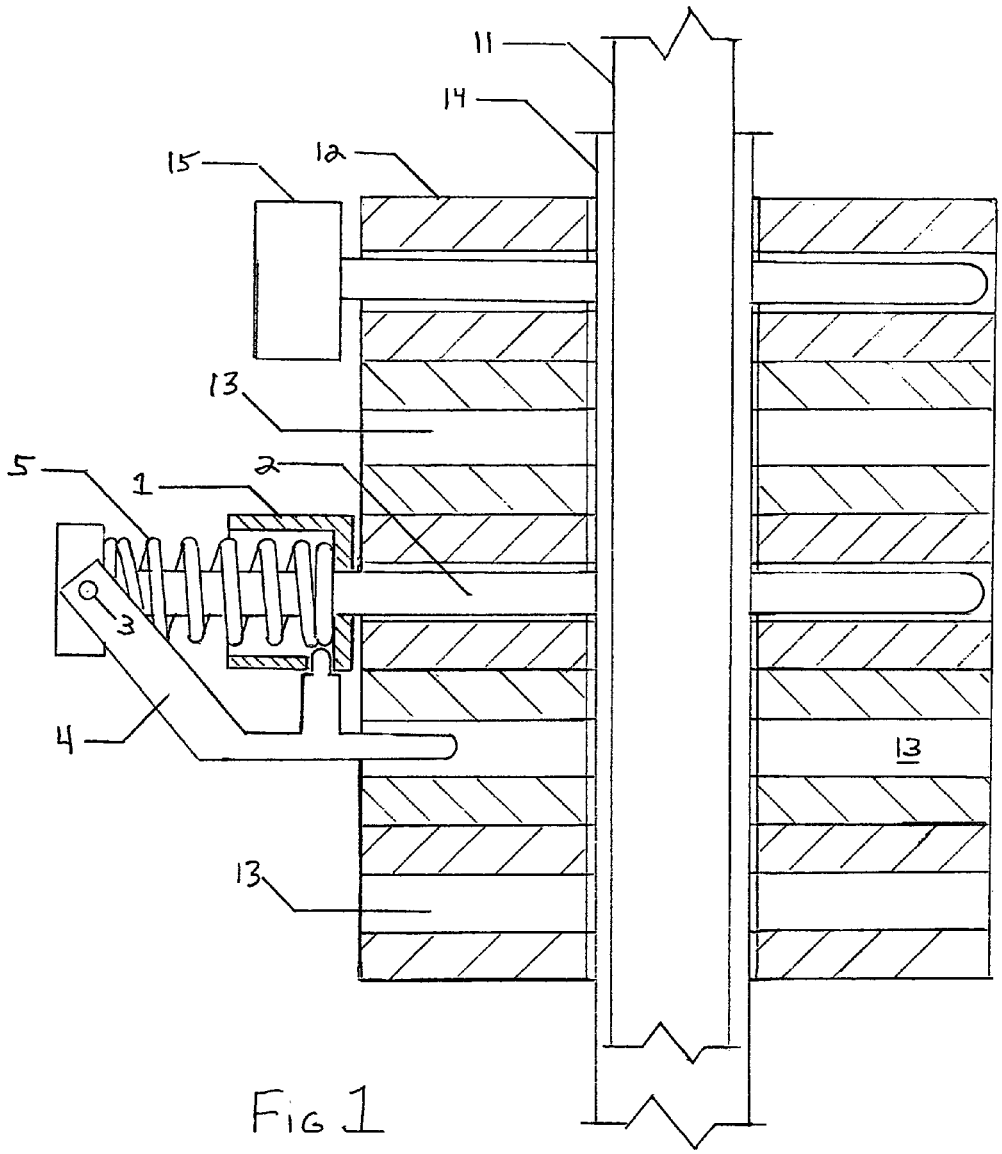
FIG. 1 illustrates a side view and cross section of a typical selectorized weight stack at rest with standard weight stack pin inserted above and an embodiment of Selectorized Weight Stack Ejecting Pin positioned below with a portion of the trigger latch member inserted into an unoccupied opening below shaft.

In reference to FIG. 1, selectorized weight stack side view, with device installed below pin 15. Selectorized equipment typically refers to any fitness apparatus utilizing; guide rods 11, weight plates 12 with selector slots 13 which correspond with openings in a selector shaft 14 that passes vertically, perpendicularly through the weight plates 12 and a pin 15 which is inserted into a desired selector slot 13; intersecting selector shaft 14 which is ultimately connected to various equipment apparatus. Actual dimensions will vary from different manufactures, selector shaft slots correspond to weight plate slots when assembled vertically, material used in manufacture of weight plates is not dependent of device function.

Figure 2:
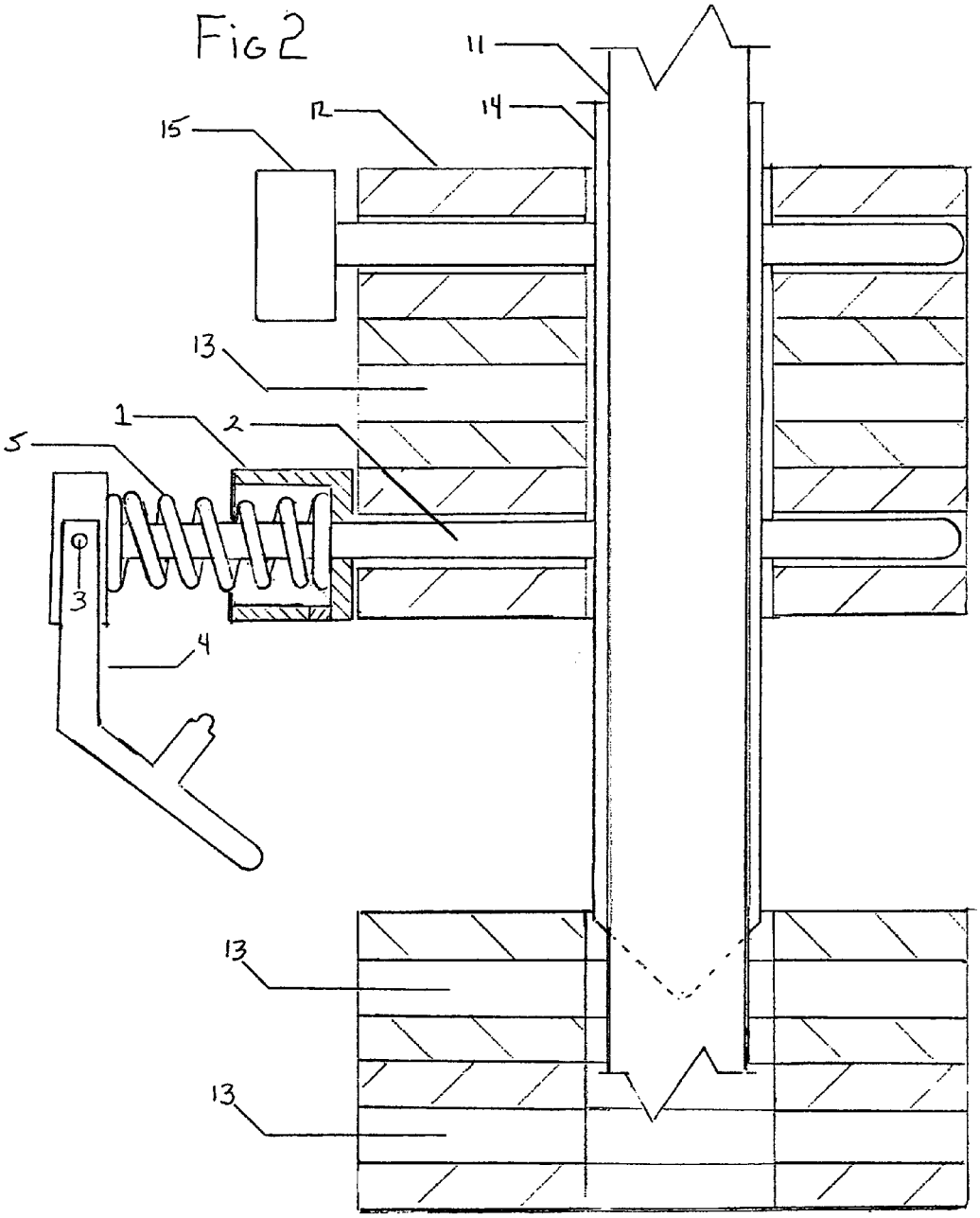
FIG. 2 illustrates a side view and cross section of a typical selectorized weight stack in use with standard pin inserted above and an embodiment of Selectorized Weight Stack Ejecting Pin positioned below in the active position after trigger latch is released by vertical movement of the weight stack.
Figure 8:
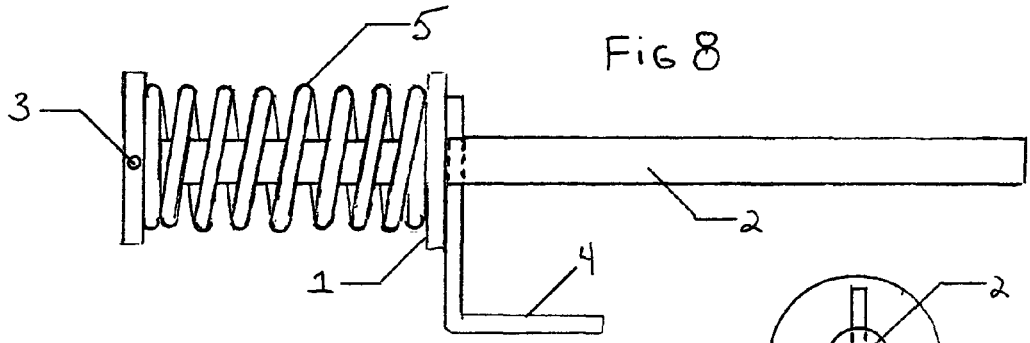
FIG. 8 illustrates a side view of an embodiment in the active position.
Figure 9:
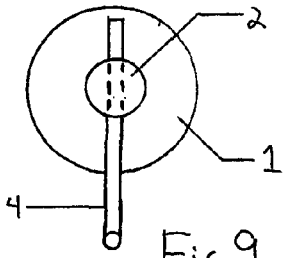
FIG. 9 illustrates a front view of FIG. 8.
Figure 10:
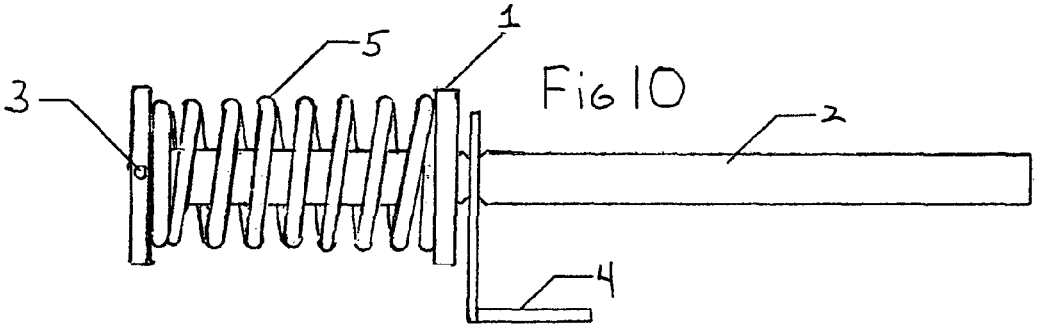
FIG. 10 illustrates a side view of an embodiment in the active position employing a trigger latch.
Figure 11:
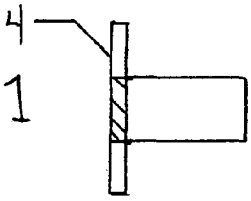
FIG. 11 illustrates a top view embodiment of latch trigger member used in FIG. 10.
Figure 12:
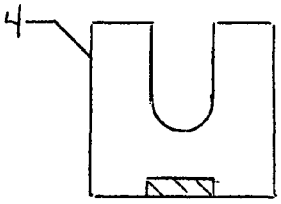
FIG. 12 illustrates a front view of trigger latch member used in FIG. 10.
Figure 13:
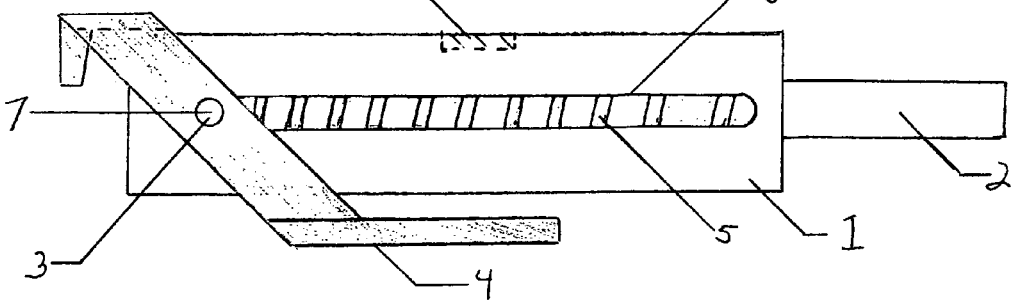
FIG. 13 illustrates a side view of the preferred embodiment in the inactive position.
Figure 14:
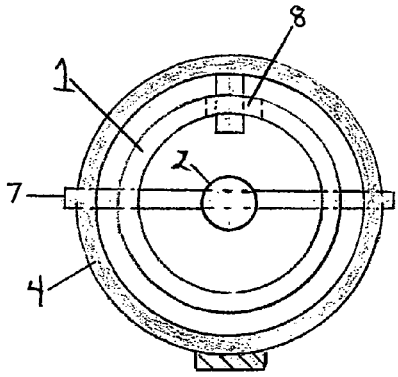
FIG. 14 illustrates a cross sectional front view of FIG. 13.
Figure 15:
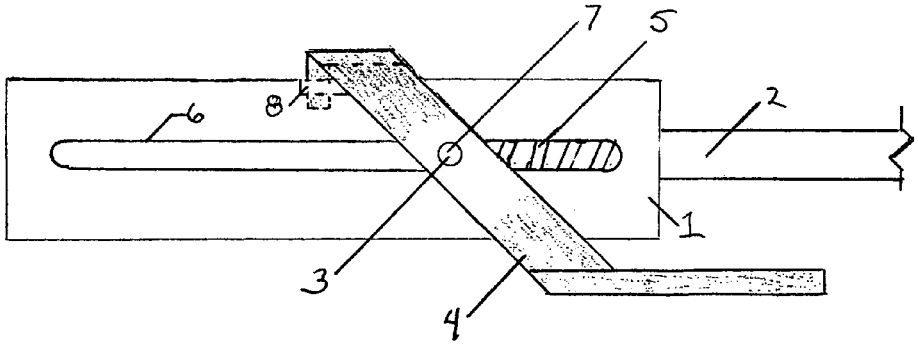
FIG. 15 illustrates a side view of the preferred embodiment in the active position.

This device is used in addition to the pin 15 used for normal operation but is unlike the standard selectorized weight stack pin 15 used in normal operation of selectorized equipment weight stacks which are designed to stay in the weight stack until manually moved by the user each time resistance is returned to the resting position. When an embodiment of the invention is activated and inserted in selected position on said equipment, with a portion of the trigger latch 4 inserted into any unoccupied selector slot 13 below pin shaft 2, it will secure resistance selected when exercise is commenced. Once weight is returned to resting position, the device will eject itself from selected position to allow exercise to resume at next predetermined selection. This can be repeated if additional devices are used or a pin 15 remains. In reference to FIG. 4, the device consists of; body 1; retains first end of biasing means 5 at minimum, is allowed to travel freely along pin shaft 2 and is commonly known as the live end. Pin shaft 2 of sufficient dimensions and mechanical properties to support resistance selection chosen when inserted into unoccupied selector slot 13. Attachment end 3, described second end of pin shaft 2; and second end of biasing means 5, maintains second end of biasing means 5 commonly known as the dead end. Trigger latch 4, once body 1 is moved toward attachment end 3, stores energy of biasing means 5; preventing body 1 from traveling freely along shaft 2 away from attachment end 3 until desired. Trigger latch 4 can be attached to pin shaft 2, biasing means or remain an independent member, as referenced in FIGS. 4 through 12. When biasing means 5 is compressed and trigger latch 4 is set, a portion of trigger latch 4 extends beyond body 1, and is able to enter any unoccupied selector slot 13 beneath pin shaft 2 position, as referenced in FIG. 1. In FIGS. 1 and 2, biasing means 5; of sufficient power to remove pin shaft 2 and related assembly from selector slot 13 but not to overcome friction of selector shaft 14 and weight plate 12 when in use, provides stored energy repelling body 1 and attachment end 3. Included illustrations show a compression coil spring but can be of magnetic, pneumatic, hydraulic, electro-mechanical power source to achieve the biasing action but at greater cost and complexity and beyond the claim listed. In reference to FIG. 1, use of device: body 1 is moved toward anchor end 3 compressing biasing means 5; trigger latch 4 is positioned to retain biasing means 5 in a stored energy position maintaining body 1 and attachment end 3 relative position. Pin shaft 2 is inserted into desired selector slot 13; a portion of the trigger latch 4 is inserted into an unoccupied selector slot 13 below pin shaft 2. In reference to FIG. 2, once exercise is commenced, weight stack is vertically moved up via selector shaft 14, moving selected weight plates and invention vertically up. A portion of trigger latch 4 previously captured by weight slot 13 below causes the release. At this point the trigger latch 4 is released and no longer retains biasing means 5 or maintains body 1 to anchor end 3 relative position. Pin shaft 2 is immediately held in position by the friction of selector shaft 14 moving vertically up and weight plate 12 moving vertically down; holding pin shaft 2 in position; maintaining relative position of body 1 and anchor end 3. Depending on constructed embodiment, trigger latch 4 may fall free of device assembly or remain attached to any portion of body 1, pin shaft 2 or biasing means 5. Device will stay in position until weight is returned to resting position, releasing stored energy of biasing means 5; allowing anchor end 3 to move away from body 1 removing pin shaft 2 from selector slot 13 and selector shaft 14 allowing additional devices or pin 15 vertically above this position to engage selector shaft 14 inserted into corresponding selector slot 13 and resume exercise. In reference to FIG. 8 shown is a side view, FIG. 9 is the face view of device with trigger latch 4 constructed of a suitable wire formed to intersect pin shaft 2 through a corresponding opening through the pin shaft 2 at a position where biasing means 5 is compressed and a portion of this wire form trigger latch 4 is able to enter an unoccupied opening below pin shaft 2. In reference to FIG. 10, shown is side view of device with trigger latch 4 constructed to fit into a groove formed into pin shaft 2 at point where biasing means 5 is compressed and able to enter an unoccupied opening below shaft 2. In reference to FIG. 13, shown is device with side view of body 1 completely enveloping biasing means 5 with longitudinal slots 6 positioned on body 180° apart, allowing attachment end 3 connection to trigger latch 4 to travel along body to compress biasing means 5. Trigger latch 4 and axle 7 may be independent of attachment end 3 perpendicularly intersecting body 1 through longitudinal slots 6 with axle 7. Trigger latch 4 is able to partially rotate, clockwise relative to view, to clear body 1, able to compress biasing means 5 by moving closer to the body 1 or live end at position where the trigger latch 4 can partially rotate counter clockwise to engage opening 8 located 90° of longitudinal slots 6 at a position where the biasing means 5 is compressed sufficiently and portion of the trigger latch 4 extends beyond body 1 and is able to enter an unoccupied opening 13 below pin shaft 2 as illustrated in FIG. 15. FIG. 14 is a cross sectional front view showing the concentric arrangement of this embodiment. FIG. 15 shows the device with the biasing means in the compressed position with trigger latch 4 engaged with a portion of the trigger latch able to enter an unoccupied opening 13 below pin shaft 2.

Although this invention has been explained in relation to its preferred embodiment, it is to be understood that many other variations and modifications can be made without departing from the intent and scope of the invention claimed.

What is claimed is:

1. A weight stack pin device, comprising:

a pin shaft having a proximal end and a distal end, the distal end being configured for insertion within a first selector slot of a first weight of a weight stack, the proximal end comprising an attachment end;

a body slidably positioned on the pin shaft between a loaded position and a released position;

a biasing means having a distal end in contact with the body and a proximal end connected to the attachment end, the biasing means having a compressed position and a relaxed position, wherein the loaded position of the body corresponds to the compressed position of the biasing means, and the released position of the body corresponds to the relaxed position of the biasing means; and a trigger latch coupled to the pin shaft and having a first extension that selectively contacts the body to maintain the loaded position of the body, the trigger latch further comprising a second extension that is configured to be inserted within a second selector slot of a second weight of the weight stack, wherein the trigger latch is disposed proximal to the proximal end of the biasing means, wherein upon removal of the first extension from contact with the body, the body moves to the released position as the biasing means moves to the relaxed position.

2. The device of claim 1, wherein the trigger latch is hingedly coupled to the attachment end of the pin shaft.

3. The device of claim 2, wherein the body further comprises a longitudinal slot through which an axle is inserted, and wherein the trigger latch is hingedly coupled to the attachment end of the pin shaft via the axle.

4. The device of claim 3, wherein the body further comprises an opening positioned 90° to the longitudinal slot and configured to receive the first extension of the trigger latch to maintain the loaded position of the body.

5. The device of claim 1, wherein the first extension of the trigger latch is positioned in proximity to a top surface of the body and the second extension of the trigger latch is positioned in proximity to a bottom surface of the body.

6. The device of claim 5, wherein the top and bottom surfaces are longitudinal top and bottom surfaces.

7. The device of claim 1, wherein the proximal end of the pin shaft and the entire biasing means are enclosed within an interior of the body.

8. The device of claim 1, wherein a distal end of the second extension is positioned distally to a distal end of the body when in the loaded position.

9. The device of claim 1, wherein the trigger latch is selectively coupled to the proximal end via friction when the first extension is selectively in contact with the body in the loaded position.

10. The device of claim 9, wherein the first extension of the trigger latch is oriented approximately 90° relative to the second extension.

11. The device of claim 1, wherein the first extension of the trigger latch is selectively coupled to an opening of the pin shaft such that a distal end of the body contacts a proximal surface of the first extension when in the loaded position, wherein frictional contact by the body and the opening against the first extension maintains the trigger latch within the opening of the pin shaft, and wherein the second extension is oriented perpendicular to the first extension.

12. The device of claim 1, wherein the first extension of the trigger latch is selectively coupled to a groove of the pin shaft such that a distal end of the body contacts a proximal surface of the first extension when in the loaded position, wherein frictional contact by the body and the groove against the first extension maintains the trigger latch within the groove of the pin shaft, and wherein the second extension is oriented perpendicular to the first extension.

13. A weight stack pin device, comprising:

a pin shaft having a proximal end and a distal end, the distal end being configured for insertion within a first selector slot of a first weight of a weight stack, the proximal end comprising a body slidably positioned on the pin shaft and having a proximal surface for receiving a distal end of a biasing means, the proximal end further comprising an attachment end to which a proximal end of the biasing means is connected, the biasing means and the body being movable between a compressed position and a relaxed position, wherein the body comprises a sidewall having a longitudinal slot forming an opening in the sidewall; and a trigger latch slidably and hingedly coupled to the longitudinal slot between an engaged position and a disengaged position, wherein when the trigger latch is in the engaged position, a first extension of the trigger latch contacts the proximal end of the pin shaft at a position between the body and the distal end of the pin shaft when the biasing means and the body are in the compressed position, and a second extension of the trigger latch is positioned parallel to the pin shaft for insertion within a second selector slot of a second weight of the weight stack.

* * * * *